US010766668B2

(12) United States Patent
Chien et al.

(10) Patent No.: US 10,766,668 B2
(45) Date of Patent: Sep. 8, 2020

(54) DRIED FOOD FRESH-KEEPING PACKAGING BAG STRUCTURE

(71) Applicants: Tsung-Ping Chien, Taichung (TW); Yi-An Chien, Taichung (TW)

(72) Inventors: Tsung-Ping Chien, Taichung (TW); Yi-An Chien, Taichung (TW)

(73) Assignee: Chuanpen International Packing Co., Ltd., Taichung (TW)

( * ) Notice: Subject to any disclaimer, the term of this patent is extended or adjusted under 35 U.S.C. 154(b) by 7 days.

(21) Appl. No.: 16/391,204

(22) Filed: Apr. 22, 2019

(65) Prior Publication Data

US 2019/0248547 A1 Aug. 15, 2019

(30) Foreign Application Priority Data

Sep. 25, 2018 (TW) ..... 107133603 A

(51) Int. Cl.

| | |
|---|---|
| ***B65D 33/01*** | (2006.01) |
| ***B65D 33/25*** | (2006.01) |
| ***B65D 81/26*** | (2006.01) |
| ***B65D 77/22*** | (2006.01) |

(52) U.S. Cl.

CPC ..... *B65D 33/01* (2013.01); *B65D 33/2508* (2013.01); *B65D 77/225* (2013.01); *B65D 81/268* (2013.01)

(58) Field of Classification Search

CPC ..... B65D 33/2508; B65D 77/225; B65D 81/268; B65D 33/01; B65D 33/25; B65D 51/1644; B65D 81/266; B65B 25/001; B65B 31/047; F16K 15/023; F16K 15/18; A23L 3/3598; A23L 3/3427; A23L 3/001

USPC ..... 383/210, 44, 45; 426/323

See application file for complete search history.

(56) References Cited

U.S. PATENT DOCUMENTS

| | | | | |
|---|---|---|---|---|
| 2,446,361 | A * | 8/1948 | Clibbon | B65D 81/268 312/31.1 |
| 3,949,934 | A * | 4/1976 | Goglio | B65D 77/225 383/103 |
| 5,515,994 | A * | 5/1996 | Goglio | B65D 51/1616 220/371 |
| 5,893,461 | A * | 4/1999 | Walters | B65D 77/225 137/493 |
| 6,056,439 | A * | 5/2000 | Graham | B65D 77/225 220/89.1 |
| 6,468,332 | B2 * | 10/2002 | Goglio | B65D 77/225 220/372 |
| 7,490,623 | B2 * | 2/2009 | Rypstra | B65D 77/225 137/246 |
| 2012/0241336 | A1 * | 9/2012 | Finley | B65D 81/3233 206/219 |
| 2016/0264332 | A1 * | 9/2016 | Rapparini | B65D 65/466 |

* cited by examiner

*Primary Examiner* — Jes F Pascua
*Assistant Examiner* — Matthew T Theis

(57) ABSTRACT

A dried food fresh-keeping packaging bag structure is provided. When the user wants to pack a dried food, a pull portion of a fresh-keeping exhaust valve is pulled outwardly toward the outside of the mouth of the packaging bag to tear a first sealing film to open a filling chamber. Then, the dried food is placed into the packaging bag, and the mouth of the packaging bag is closed. The exhaust valve blocks the outside air from returning to the interior of the packaging bag to provide a non-return exhaust effect. A preservative in the filling chamber communicates with the interior of the packaging bag to dehumidify or deoxidize the air remaining in the packaging bag.

7 Claims, 9 Drawing Sheets

DRIED FOOD FRESH-KEEPING PACKAGING BAG STRUCTURE

FIELD OF THE INVENTION

The present invention relates to a dried food fresh-keeping packaging bag structure. When in use, a pull portion is pulled outwardly to tear a first sealing film so that a filling chamber of a fresh-keeping exhaust valve is opened with ease. Then, the fresh-keeping exhaust valve performs a non-return exhaust action on the exterior of the packaging bag to exhaust most of the air in the packaging bag. At this time, a preservative in the fresh-keeping exhaust valve communicates with the interior of the packaging bag to dehumidify or deoxidize the air remaining in the packaging bag. This can reduce or avoid the deterioration of the dried food caused by the residual air and effectively prolong the shelf life of the dried food in the packaging bag.

BACKGROUND OF THE INVENTION

People have higher and higher requirements for the preservation of foods. Generally, in addition to freezing and refrigerating foods to inhibit bacterial growth, isolating air and moisture is also a way to avoid food deterioration. A conventional packaging bag is used for packaging dried foods. When the packaging bag is opened, there is no re-sealing structure. Another packaging bag is provided with a zipper for temporarily closing the mouth of the bag to prevent food from falling out or preventing cockroaches or other insects from entering the bag to contaminate the food. Because there is still a lot of air in the bag, the food (such as coffee, tea, etc.) in the bag may be deteriorated due to moisture.

Taiwan Utility Model Publication No. M564875, discloses a "Choke Valve for Packaging Bags". A packaging bag is provided with a plurality of air outlets. A choke valve is attached to the inner side of the packaging bag, corresponding in position to the air outlets. The chamber of the choke valve is provided with a diaphragm that is confined by a plurality of stoppers for blocking a plurality of air holes on the bottom surface of the chamber. When the packaging bag is squeezed, the diaphragm is pushed up by the air from the air holes, and the air is exhausted through the air outlets. A pressure difference is formed inside and outside of the bag, so that the diaphragm is attached to the air holes to prevent outside air and moisture from entering the packaging bag. The above-mentioned conventional choke valve can exhaust the air in the bag to the outside by squeezing the bag and can prevent outside air from entering the bag to reduce the effect of air or moisture on the oxidative deterioration of the food.

By squeezing the packaging bag, most of the air in the packaging bag can be exhausted to the outside. However, a little air will be left in the bag. The little air still affects the deterioration or freshness of the food, and it is unable to ensure the safe shelf life of the food.

In view of this, the conventional dried food packaging bag needs to be improved, and its safety and convenience still need to be improved. Accordingly, the inventor of the present invention has devoted himself based on his many years of practical experiences to solve these problems and develop a dried food fresh-keeping packaging bag structure.

SUMMARY OF THE INVENTION

The primary object of the present invention is to provide a dried food fresh-keeping packaging bag structure, comprising a packaging bag and a fresh-keeping exhaust valve disposed in the packaging bag. The packaging bag is provided with at least one air vent for an interior of the packaging bag to communicate with the outside. The fresh-keeping exhaust valve comprises a valve body, a valve plate, and a preservative. The valve body is provided with a partition to partition its internal space into a valve chamber and a filling chamber. The partition is formed with at least one through hole so that the valve chamber and the filling chamber communicate with each other through the through hole. The valve plate is disposed in the valve chamber. An outer peripheral edge of an open end of the valve chamber is provided with a flange extending radially outwardly. The flange is located inside the packaging bag, having a surface attached to an inner side surface of the packaging bag relative to the air vent so that the valve chamber communicates with the outside through the air vent. The preservative is disposed in the filling chamber. An inlet end of the filling chamber is provided with a first breathable film to confine the preservative within the filling chamber. An outer surface of the first breathable film is provided with a first sealing film. One end of the first sealing film extends to an outside of a mouth of the packaging bag to form a pull portion.

When the user wants to use the packaging bag for preserving a dried food, the pull portion is pulled outwardly toward the outside of the mouth of the packaging bag to tear the first sealing film from the outer surface the filling chamber so that the filling chamber is opened. Then, the dried food is placed into the packaging bag. After the mouth of the packaging bag is closed, when the outside of the packaging bag is squeezed, the air inside the packaging bag passes through the filling chamber, the preservative and the through hole to push away the valve plate, and then the air is exhausted to the outside from the air vent of the packaging bag. When the air vent is stopped to exhaust, the valve plate is returned to close the through hole, thereby preventing the outside air from returning to the interior of the packaging bag so as to provide a non-return effect. After the outside of the packaging bag is squeezed, the air, not exhausted, is remained in the packaging bag. By the preservative in the filling chamber being in communication with the interior of the packaging bag, the preservative is configured to dehumidify or deoxidize the air remaining in the packaging bag. This can reduce or avoid the deterioration of the dried food caused by the residual air and effectively prolong the shelf life of the dried food in the packaging bag.

Preferably, the pull portion is provided with a clip slit to form a clip piece through the clip slit. The pull portion is clipped to the mouth of the packaging bag through the clip piece, and the pull portion is held on the outside of the mouth of the packaging bag.

Preferably, a second breathable film is disposed one side of on the partition of the valve body relative to the through hole.

Preferably, the open end of the valve chamber of the valve body is provided with a second sealing film attached to the flange. A surface of the second sealing film is attached to the inner surface of the packaging bag. The second sealing film is provided with at least one perforation relative to the air vent of the packaging bag for the valve chamber to communicate with the air vent.

The dried food fresh-keeping packaging bag structure of the present invention has an innovative and unique design. First, the first sealing film is torn through the pull portion, and the filling chamber of the fresh-keeping exhaust valve is opened easily. The fresh-keeping exhaust valve performs a non-return exhaust action on the interior of the packaging bag to exhaust most of the air in the packaging bag. At this time, the preservative in the filling chamber is in communication with the interior of the packaging bag, the preservative is configured to dehumidify or deoxidize the air remaining in the packaging bag. This can reduce or avoid the deterioration of the dried food caused by the residual air and effectively prolong the shelf life of the dried food in the packaging bag.

DETAILED DESCRIPTION OF THE PREFERRED EMBODIMENTS

Embodiments of the present invention will now be described, by way of example only, with reference to the accompanying drawings.

Figure 1:
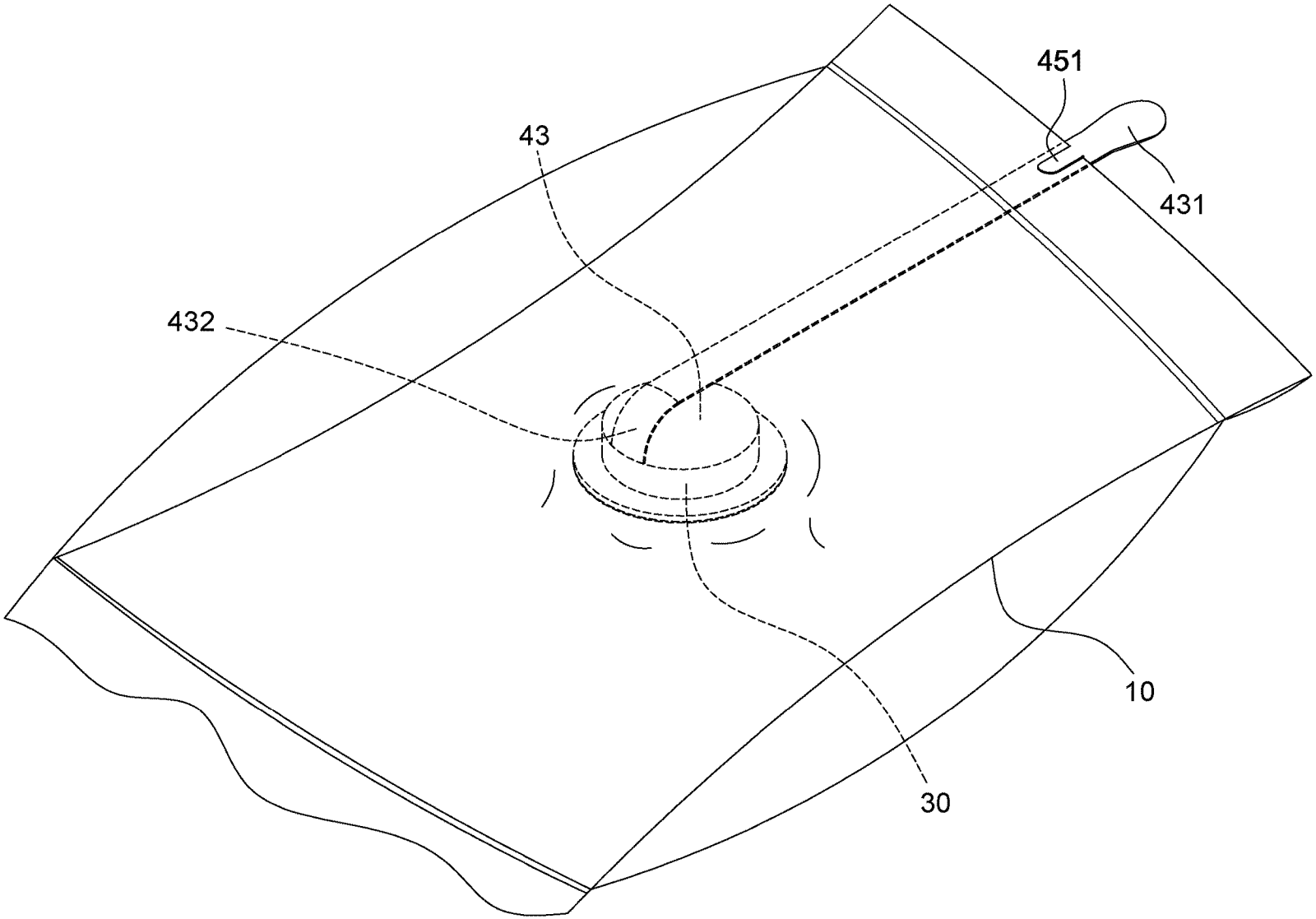
FIG. 1 is a first perspective view of the present invention.
Figure 2:
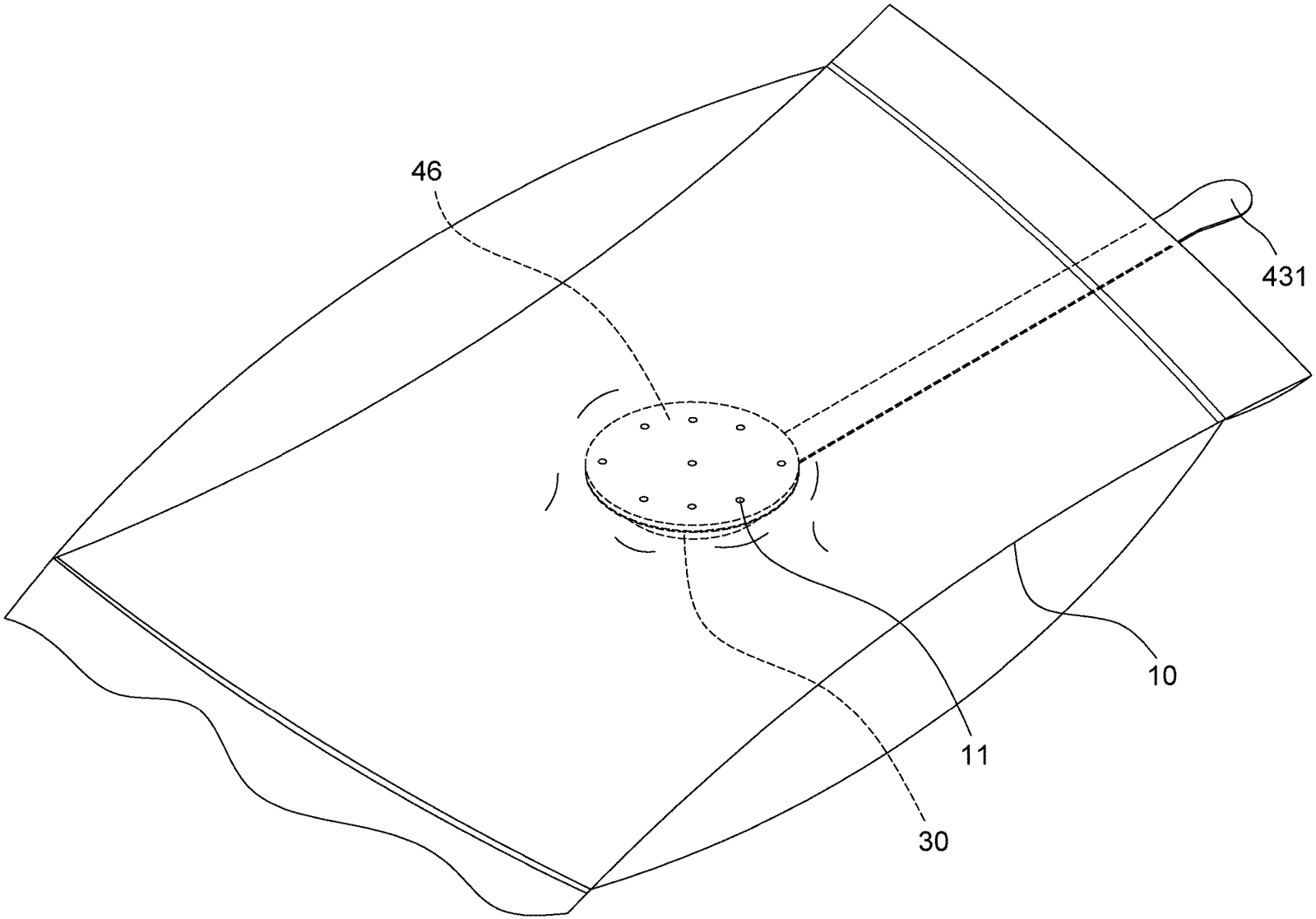
FIG. 2 is a second perspective view of the present invention.
Figure 3:
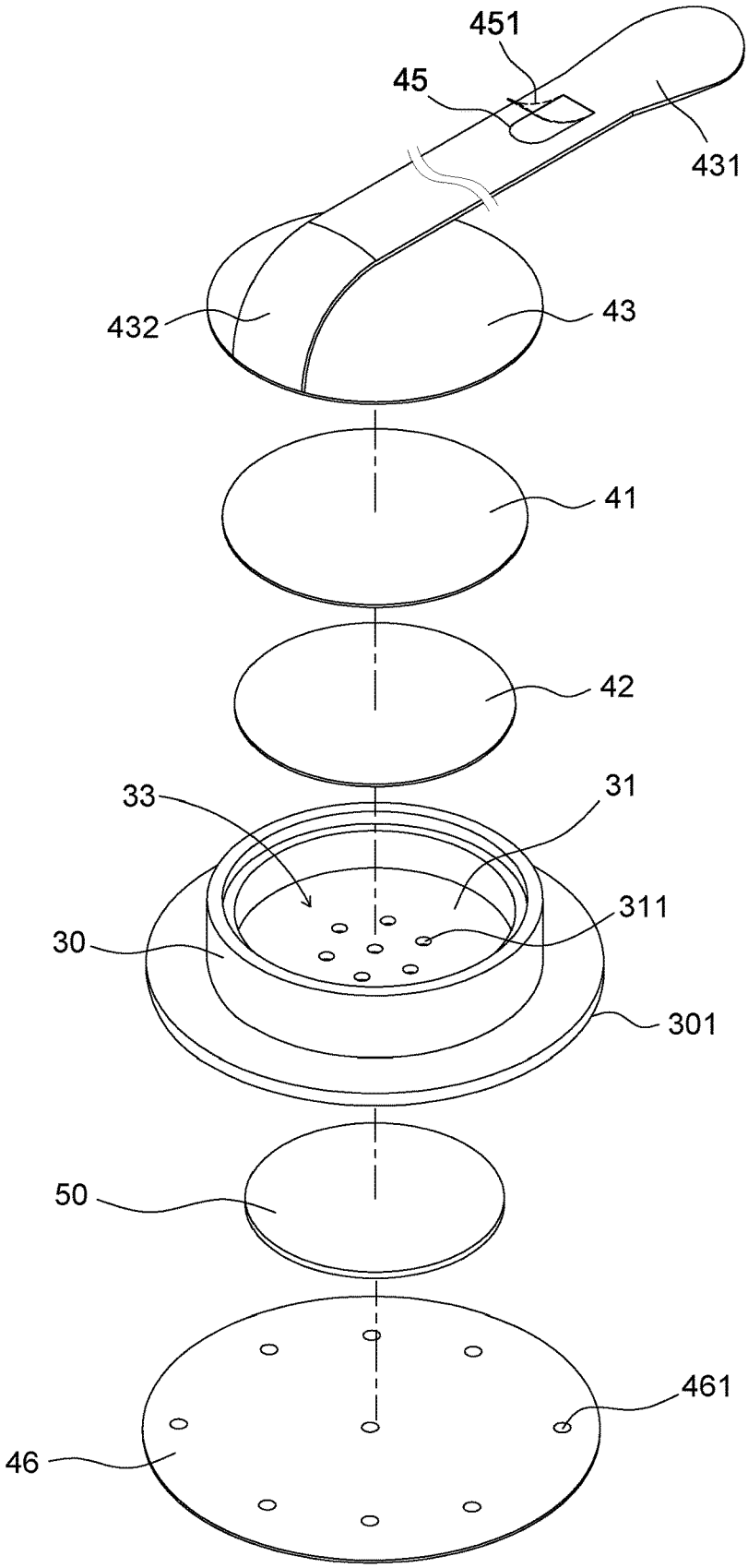
FIG. 3 is an exploded view of the present invention.

As shown in FIG. 1 through FIG. 3, a dried food fresh-keeping packaging bag structure in accordance with a preferred embodiment of the present invention comprises a packaging bag 10 and a fresh-keeping exhaust valve 20 disposed in the packaging bag 10. The packaging bag 10 is provided with at least one air vent 11 for the interior of the packaging bag 10 to communicate with the outside. The fresh-keeping exhaust valve 20 comprises a valve body 30, a valve plate 50, and a preservative 50. The valve body 30 is provided with a partition 31 to partition its internal space into a valve chamber 33 and a filling chamber 35. The partition 31 is formed with at least one through hole 311, so that the valve chamber 33 and the filling chamber 35 communicate with each other through the through hole 311. The valve plate 50 is disposed in the valve chamber 33. An outer peripheral edge of an open end of the valve chamber 33 is provided with a flange 301 extending radially outwardly. The flange 301 is located inside the packaging bag 10, having a surface attached to an inner side surface of the packaging bag 10 relative to the air vent 11, so that the valve chamber 33 communicates with the outside through the air vent 11. The preservative 60 is disposed in the filling chamber 23. An inlet end of the filling chamber 35 is provided with a first breathable film 41 to confine the preservative 60 within the filling chamber 35. The outer surface of the first breathable film 41 is provided with a first sealing film 43. One end of the first sealing film 43 extends to the outside of a mouth of the packaging bag 10 to form a pull portion 431.

Figure 4:
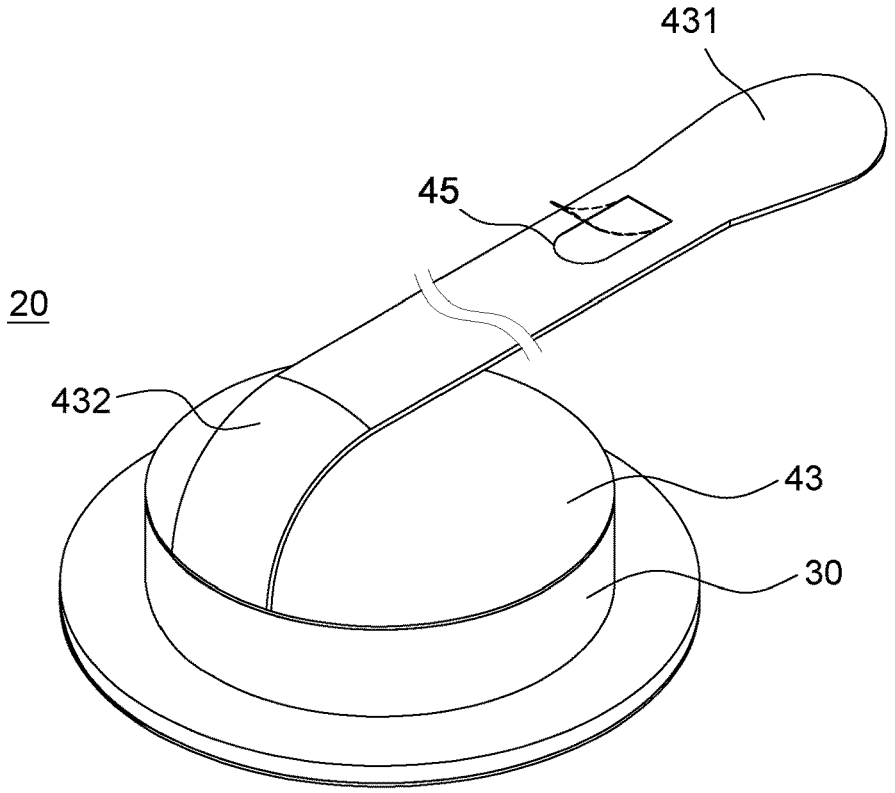
FIG. 4 is a perspective view of the fresh-keeping exhaust valve of the present invention.

Referring to FIG. 3 and FIG. 4, the pull portion 431 is provided with a U-shaped or V-shaped clip slit 45 to form a clip piece 451 through the clip slit 45. The pull portion 431 is clipped to the mouth of the packaging bag 10 through the clip piece 451, and the pull portion 431 is held on the outside of the mouth of the packaging bag 10.

Figure 5:
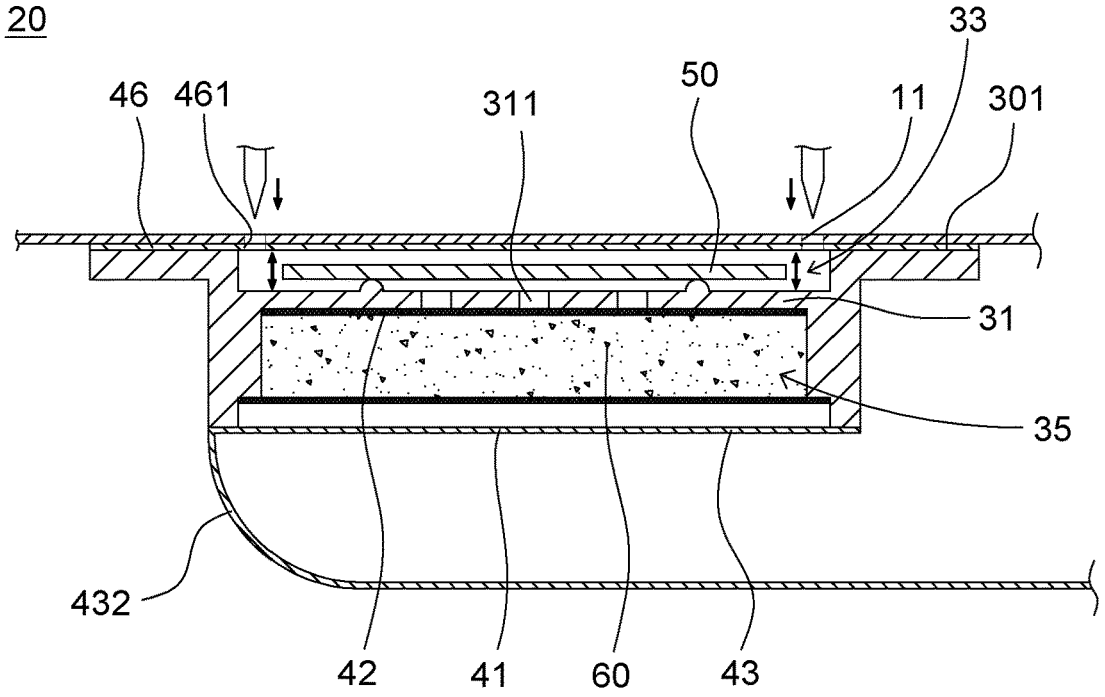
FIG. 5 is a cross-sectional view of the fresh-keeping exhaust valve of the present invention.

In addition, as shown in FIG. 5 and FIG. 3, a second breathable film 42 is disposed one side of on the partition 31 of the valve body 30 relative to the through hole 311. The second breathable film 42 can prevent the preservative 60 in the filling chamber 35 from entering the valve chamber 33, so that the valve plate 50 can be opened and closed normally. If the preservative 60 enters the valve chamber 33, the valve plate 50 may not form an airtight effect at the end of the through hole 311 to prevent air from flowing back.

Furthermore, the open end of the valve chamber 33 of the valve body 30 is provided with a second sealing film 46 attached to the flange 301. A surface of the second sealing film 46 is attached to the inner surface of the packaging bag 10. The second sealing film 46 is provided with at least one perforation 461 relative to the air vent 11 of the packaging bag 10 for the valve chamber 33 to communicate with the air vent 11. Before the fresh-keeping exhaust valve 20 is not installed inside the packaging bag 10, the interior of the valve body 30 can be completely sealed by the second sealing film 46. When the fresh-keeping exhaust valve 20 is to be installed, the perforation 461 is formed by punching. When the fresh-keeping exhaust valve 20 is mass-produced, it is advantageously stored for use.

Figure 6:
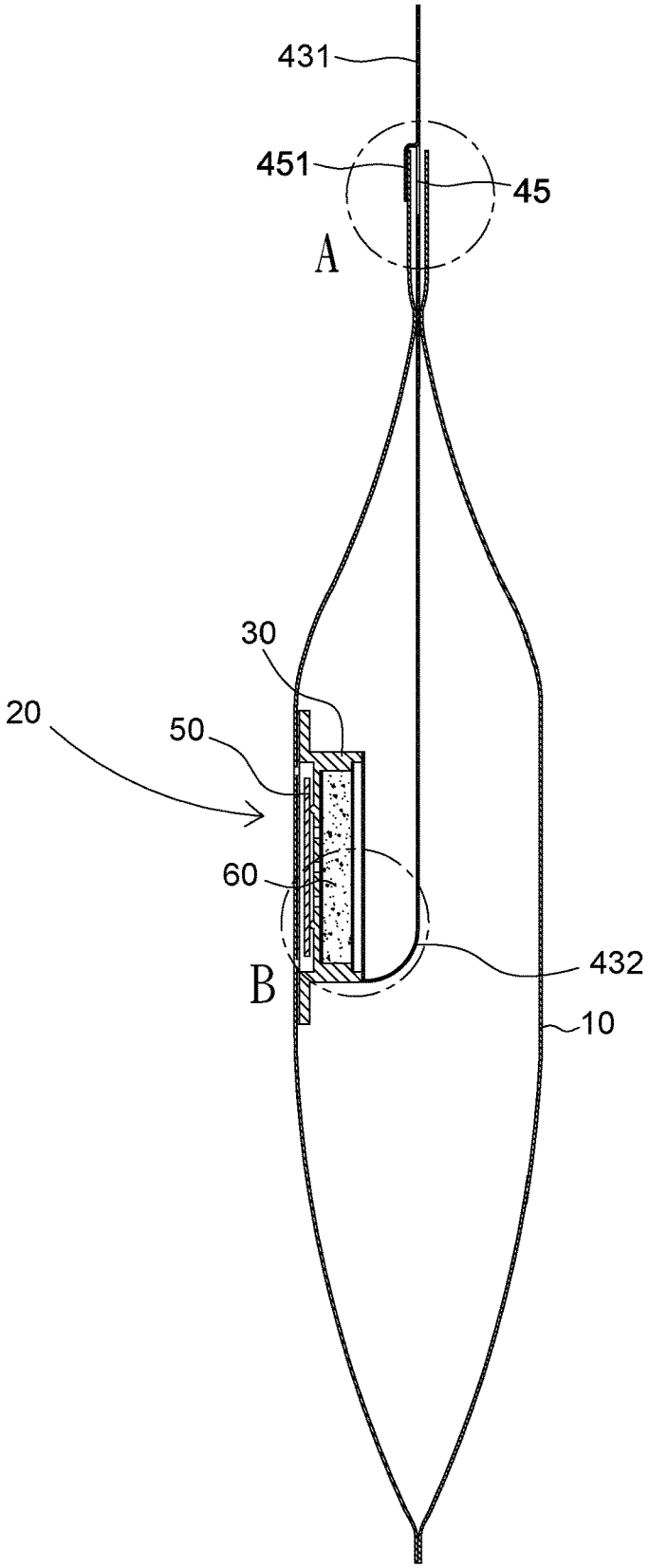
FIG. 6 is a cross-sectional view of the present invention.
Figure 6A:
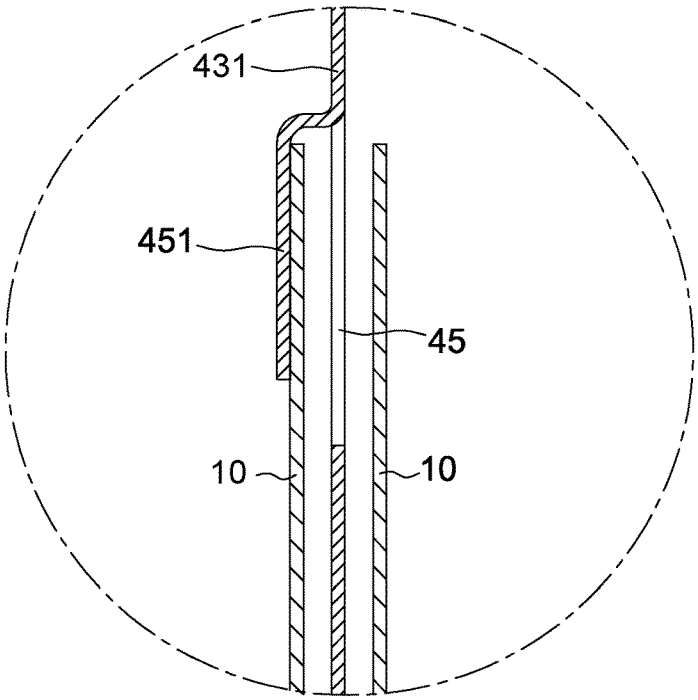
FIG. 6A is a partial enlarged view of circle A of FIG. 6.
Figure 6B:
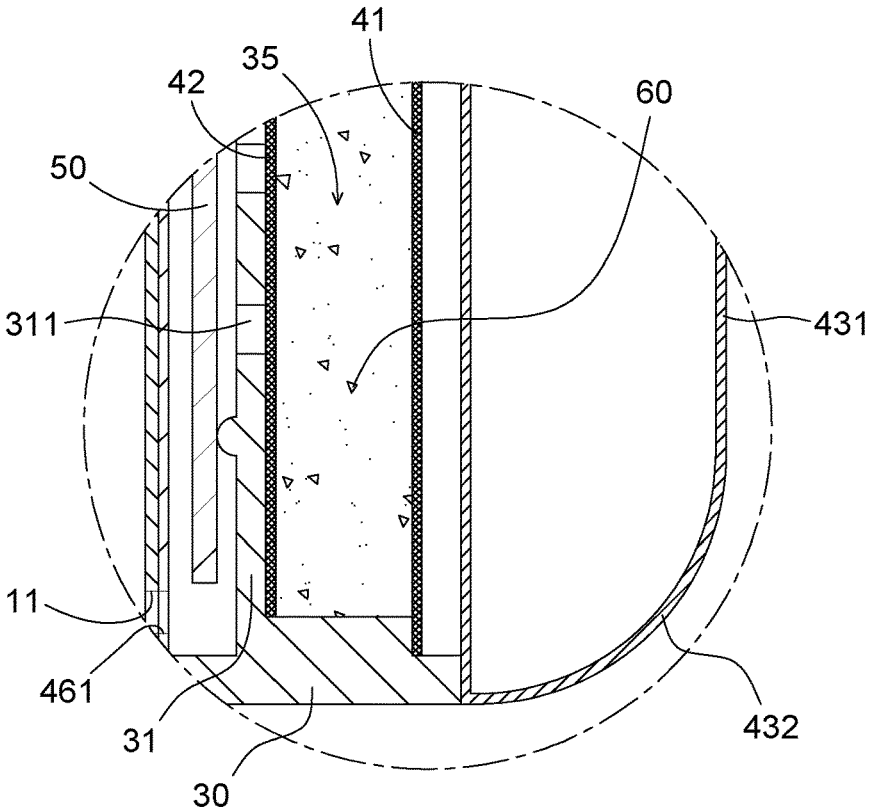
FIG. 6B is a partial enlarged view of circle B of FIG. 6.

Referring to FIG. 6 to FIG. 6B and FIG. 5, one end of the first sealing film 43 is provided with a bent portion 432 that is bent by 180 degrees and extends to the outside of the mouth of the packaging bag 10 to form the pull portion 431. The bent portion 432 is bent reversely from the inner edge of the first sealing film 43 toward the mouth of the packaging bag 10.

Figure 7:
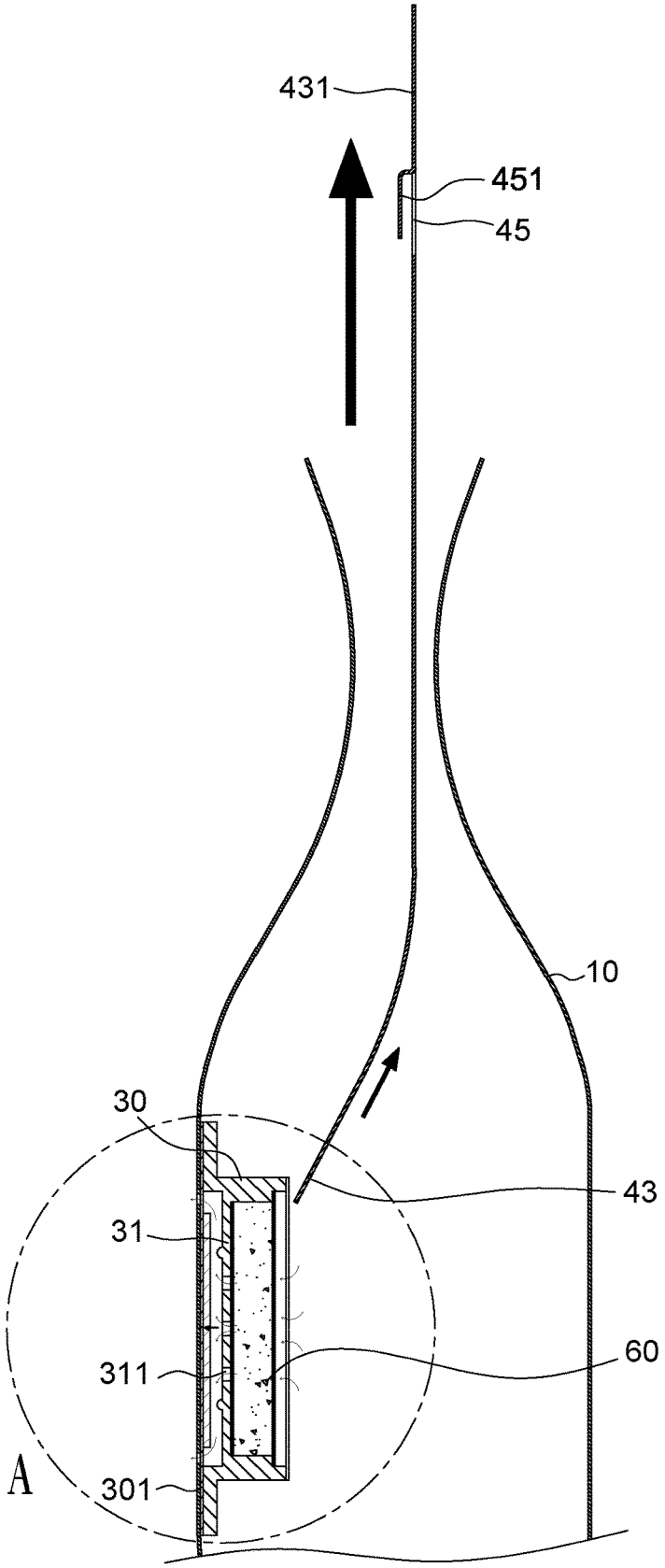
FIG. 7 is a cross-sectional view of the present invention, showing that the pull portion is torn away from the valve body.
Figure 7A:
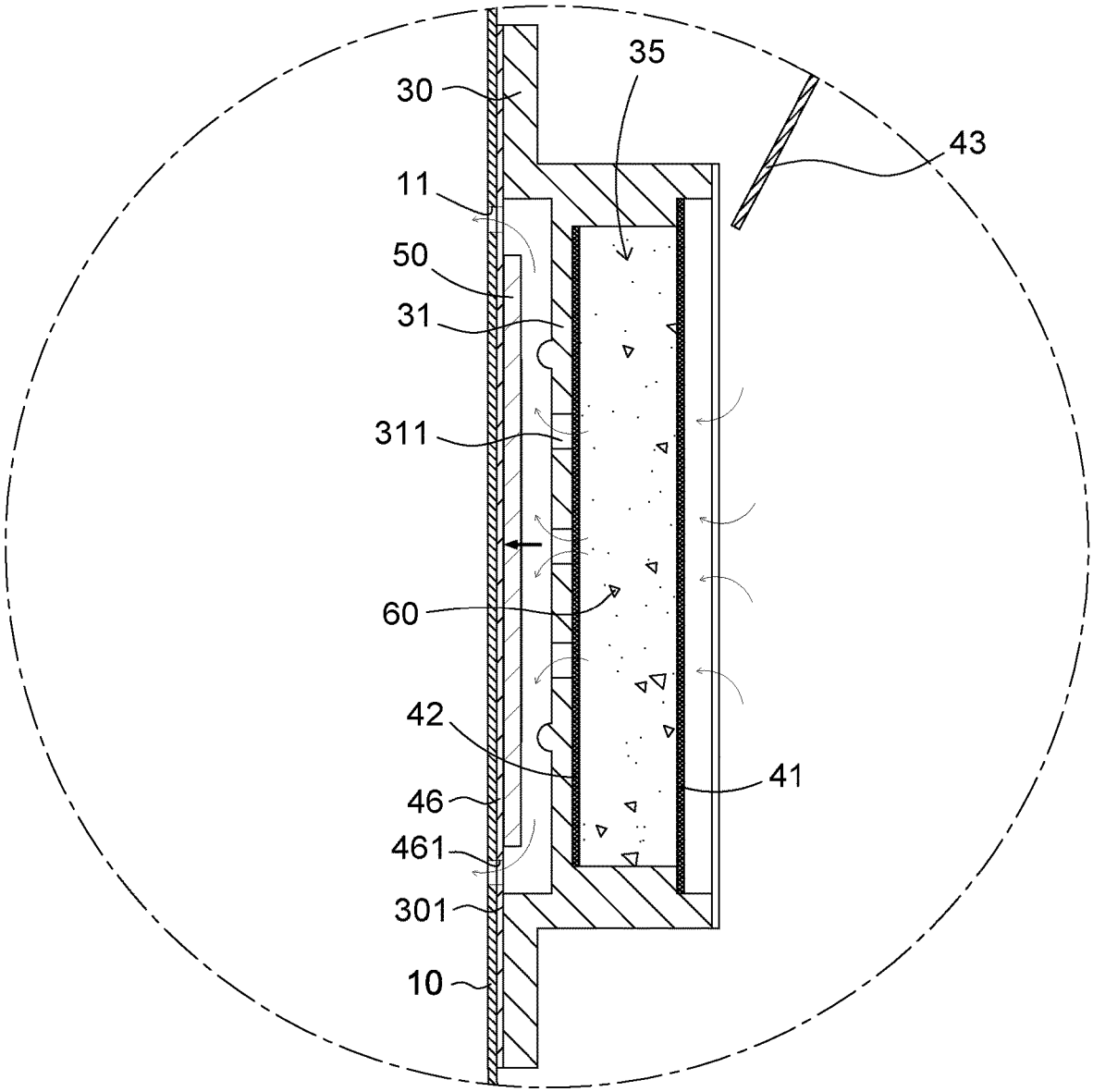
FIG. 7A is a partial enlarged view of circle A of FIG. 7.
Figure 8:
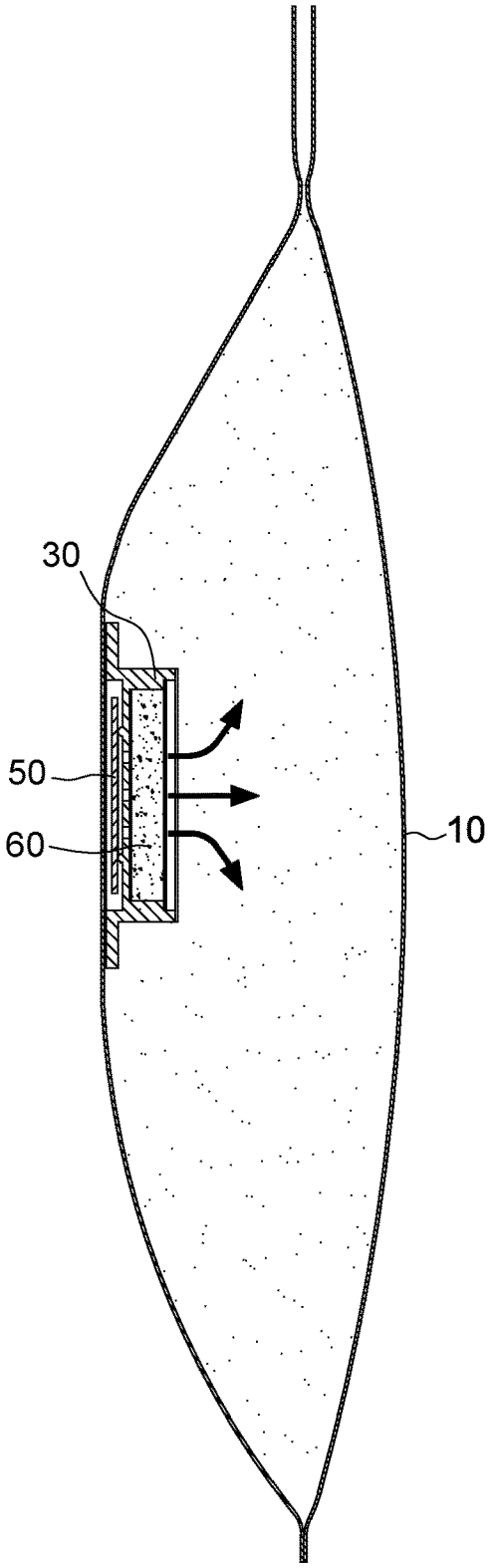
FIG. 8 is a cross-sectional view of the present invention, showing a dried food packed in the interior of the packaging bag.

In detail, referring to FIG. 7 and FIG. 8 in conjunction with FIG. 5, when the user wants to use the packaging bag 10 for preserving a dried food, the pull portion 431 is pulled outwardly toward the outside of the mouth of the packaging bag 10 to tear the first sealing film 43 from the outer surface the filling chamber 35 so that the filling chamber 35 is opened. Then, the dried food is placed into the packaging bag 10. After the mouth of the packaging bag 10 is closed, when the outside of the packaging bag 10 is squeezed, the air inside the packaging bag 10 passes through the filling chamber 35, the preservative 60 and the through hole 311 to push the valve plate 50 away, and then the air is exhausted to the outside from the air vent 11 of the packaging bag 10. When the air vent 11 is stopped to exhaust, the valve plate 50 is returned to close the through hole 311, thereby preventing the outside air from returning to the interior of the packaging bag 10 so as to provide a non-return exhaust effect. After the outside of the packaging bag 10 is squeezed, the air, not exhausted, is remained in the packaging bag 10. By the preservative 60 in the filling chamber 35 to communication with the interior of the packaging bag 10, the preservative 60 can dehumidify or deoxidize the air remaining in the packaging bag 10. This can reduce or avoid the deterioration of the dried food caused by the residual air and effectively prolong the shelf life of the dried food in the packaging bag 10.

The packaging bag 10 may be changed according to actual needs. The packaging bag 10 is a zipper bag, or the packaging bag 10 is a heat seal bag sealed by a heat sealer.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A dried food fresh-keeping packaging bag structure, comprising a packaging bag and a fresh-keeping exhaust valve disposed in the packaging bag, the packaging bag being provided with at least one air vent for an interior of the packaging bag to communicate with the outside, the fresh-keeping exhaust valve comprising a valve body, a valve plate and a preservative;

the valve body being provided with a partition to partition its internal space into a valve chamber and a filling chamber;

the partition being formed with at least one through hole so that the valve chamber and the filling chamber communicate with each other through the through hole;

the valve plate being disposed in the valve chamber, an outer peripheral edge of an open end of the valve chamber being provided with a flange extending radially outwardly, the flange being located inside the packaging bag, having a surface attached to an inner side surface of the packaging bag relative to the air vent so that the valve chamber communicates with the outside through the air vent;

the preservative being disposed in the filling chamber, an inlet end of the filling chamber being provided with a first breathable film to confine the preservative within the filling chamber, an outer surface of the first breathable film being provided with a first sealing film, one end of the first sealing film extending to an outside of a mouth of the packaging bag to form a pull portion.

2. The dried food fresh-keeping packaging bag structure as claimed in claim 1, wherein the pull portion is provided with a clip slit to form a clip piece through the clip slit.

3. The dried food fresh-keeping packaging bag structure as claimed in claim 1, wherein a second breathable film is disposed on one side of the partition of the valve body relative to the through hole.

4. The dried food fresh-keeping packaging bag structure as claimed in claim 1, wherein the open end of the valve chamber of the valve body is provided with a second sealing film attached to the flange, a surface of the second sealing film is attached to the inner surface of the packaging bag, and the second sealing film is provided with at least one perforation relative to the air vent of the packaging bag for the valve chamber to communicate with the air vent.

5. The dried food fresh-keeping packaging bag structure as claimed in claim 1, wherein one end of the first sealing film is provided with a bent portion that is bent by 180 degrees and extends to the outside of the mouth of the packaging bag to form the pull portion, and the bent portion is bent reversely from an inner edge of the first sealing film toward the mouth of the packaging bag.

6. The dried food fresh-keeping packaging bag structure as claimed in claim 1, wherein the packaging bag is a zipper bag.

7. The dried food fresh-keeping packaging bag structure as claimed in claim 1, wherein the packaging bag is a heat seal bag sealed by a heat sealer.

* * * * *